US008059083B2

(12) United States Patent
Shin et al.

(10) Patent No.: US 8,059,083 B2
(45) Date of Patent: Nov. 15, 2011

(54) LIQUID CRYSTAL DISPLAY APPARATUS

(75) Inventors: Seong-Sik Shin, Gyeonggi-do (KR); Jong-Seo Lee, Gyeonggi-do (KR); Jung-Suk Han, Seoul (KR); Tae-Jong Jun, Gyeonggi-do (KR); Joo-Young Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 730 days.

(21) Appl. No.: 11/696,645

(22) Filed: Apr. 4, 2007

(65) Prior Publication Data

US 2007/0236446 A1 Oct. 11, 2007

(30) Foreign Application Priority Data

Apr. 6, 2006 (KR) ..... 10-2006-0031365

(51) Int. Cl.
*G09G 3/36* (2006.01)
*G09G 3/32* (2006.01)
*G09F 13/04* (2006.01)

(52) U.S. Cl. ..... 345/102; 345/82; 362/97.1; 362/97.2; 362/97.3

(58) Field of Classification Search ..... 345/690–693, 345/698, 82–83, 87–88, 102; 362/97.1–97.3, 362/231, 800; 349/61, 62; 313/498, 500
See application file for complete search history.

(56) References Cited

U.S. PATENT DOCUMENTS 5,768,665 A * 6/1998 Yamanaka et al. ..... 399/235
6,871,975 B2 * 3/2005 Chuang ..... 362/27
7,040,794 B2 * 5/2006 Bernard ..... 362/555
7,088,333 B1 * 8/2006 Manabe et al. ..... 345/102
2003/0016205 A1 * 1/2003 Kawabata et al. ..... 345/102
2003/0193802 A1 * 10/2003 Luk ..... 362/249
2004/0246275 A1 * 12/2004 Yoshihara et al. ..... 345/690
2007/0126948 A1 * 6/2007 Kim et al. ..... 349/61

FOREIGN PATENT DOCUMENTS

| | | | |
|---|---|---|---|
| CN | 1385830 | | 12/2002 |
| CN | 1399158 | | 2/2003 |
| CN | 1713055 | | 12/2005 |
| EP | 1564478 | A1 | 8/2005 |
| JP | 2002075038 | A | 3/2002 |
| KR | 1020050080236 | | 8/2005 |
| WO | 2005111976 | A1 | 11/2005 |

OTHER PUBLICATIONS

European Search Report corresponding to EP070066153.6, dated Sep. 15, 2009, 14 pages.

European Search Report Corresponding to EP 10 01 3691, Jan. 13, 2011, 10 pages.

* cited by examiner

*Primary Examiner* — Bipin Shalwala
*Assistant Examiner* — Ilana Spar
(74) *Attorney, Agent, or Firm* — Innovation Counsel LLP

(57) ABSTRACT

An LCD apparatus displays a color image of a frame divided into a plurality of periods in which different colors are displayed. The LCD apparatus includes an LCD panel and a number of light-emitting units. The LCD panel includes a plurality of gate lines and a plurality of data lines crossing the plurality of the gate lines. The light-emitting units generate different colors in each of the periods such that an outermost light-emitting unit emits light longer than a second outermost light-emitting unit thereby enhancing luminance uniformity.

8 Claims, 6 Drawing Sheets

LIQUID CRYSTAL DISPLAY APPARATUS

CROSS-REFERENCE TO RELATED APPLICATIONS

This application relies for priority upon Korean Patent Application No. 2006-31365 filed in the Korean Intellectual Property Office on Apr. 6, 2006, the contents of which are herein incorporated by reference in its entirety.

BACKGROUND OF THE INVENTION

1. Field of the Invention

The present invention relates to a liquid crystal display (LCD) apparatus and, more particularly to an LCD apparatus capable of displaying a color image of a frame by dividing the frame into a plurality of periods in which different colors are displayed.

2. Description of the Related Art

Generally, an LCD apparatus includes a color-filter type LCD apparatus. The color filter type LCD apparatus displays a color image using white light selectively transmitted through three color filters.

The color filter type LCD apparatus includes a plurality of display pixels, each of which has the three color filters adjacent to each other, so that resolution is decreased by substantially about one third. Furthermore, due to usage of the color filter, the degree of transmittance and color purity is lowered.

In order to obviate the above-mentioned disadvantage, a color filter-less (CFL) type LCD apparatus, which uses a time-sequence driving method, has been proposed which displays colors by dividing a frame into three periods, in which a red light, green light, and blue light are sequentially provided.

The CFL type LCD apparatus includes an LCD panel and light-emitting units in which the LCD panel displays an image and the light-emitting units sequentially provide a red light, green light and blue light to the LCD panel. The light-emitting units are located parallel to each other at a rear surface of the LCD panel.

However, the amount of light arriving at the edge portion of the LCD panel is less than the amount of light arriving at the center portion of the LCD panel thereby giving rise to non-uniformity of luminance.

SUMMARY OF THE INVENTION

In accordance with one aspect of the present invention an LCD apparatus capable of improving luminance uniformity displays a color image of a frame that is divided into a plurality of periods in which different colors are displayed. The LCD apparatus includes an LCD panel and a number of light-emitting units. The LCD panel includes a plurality of gate lines and a plurality of data lines crossing a plurality of the gate lines. The light-emitting units generate different colors in each of the periods such that an outermost light-emitting unit emits light longer than adjacent light-emitting units, especially those located nearer the center of the display. For example, a first light-emitting time of a first light-emitting unit and an n-th light-emitting unit is longer than a second light-emitting time of the rest of the light-emitting units. For example, one frame is divided into three periods and the light-emitting unit sequentially generates the red light in a first period, the green light in a second period and the blue light in a third period.

Alternatively, one frame may be divided into four periods and the light-emitting unit sequentially generates the red light in a first period, the green light in a second period, the blue light in a third period and the white light in a fourth period.

In another exemplary LCD apparatus according to the present invention, the LCD apparatus displays a color image of a frame divided into a plurality of periods in which different colors are displayed. The LCD apparatus includes an LCD panel and a number of light-emitting units. The LCD panel includes a plurality of gate lines and a plurality of data lines crossing a plurality of the gate lines. Each of the light-emitting units includes a plurality of light-emitting elements generating different colors in each of the periods. An outermost light-emitting unit includes more light-emitting elements than a second outermost light-emitting unit.

One or more of the light-emitting units may include more light-emitting elements than the rest of the light-emitting units.

In a still another LCD apparatus according to the present invention, the light emitting units are located such that a first separation distance between a first light-emitting unit located outermost and a second light-emitting unit located second outermost is shorter than the separation distance between the second light-emitting unit and the third outermost light-emitting unit. For example, the distance between the light-emitting units is gradually increased located closer to a center portion of the LCD panel.

According to the present invention, the amount of light generated from the light-emitting units located at the edge portion is increased and thereby the uniformity of luminance is improved.

BRIEF DESCRIPTION OF THE DRAWINGS

The above and other features and advantages of the present invention will become readily apparent by reference to the following detailed description when considered in conjunction with the accompanying drawing, in which.

DESCRIPTION OF THE EMBODIMENTS

It will be understood that when an element or layer is referred to as being "on" or "connected to" another element or layer, it can be directly on or connected to the other element or layer or intervening elements or layers may be present. In contrast, when an element is referred to as being "directly on" or "directly connected to" another element or layer, there are no intervening elements or layers present. Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 1:
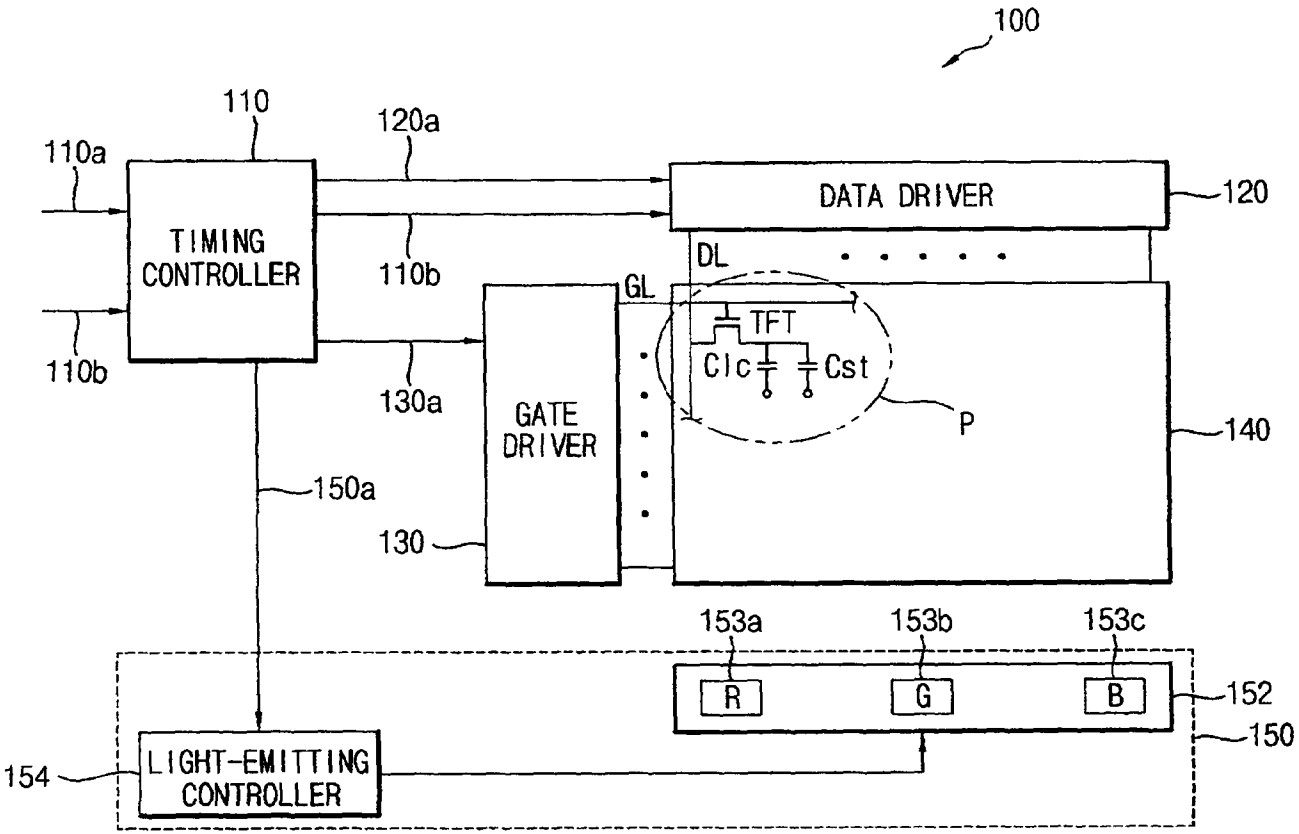
FIG. 1 is a block diagram illustrating an LCD apparatus in accordance with an example embodiment of the present invention.

FIG. 1 is a block diagram illustrating an LCD apparatus in accordance with an example embodiment of the present invention.

Referring to FIG. 1, an LCD apparatus 100 includes a timing controller 110, a data driver 120, a gate driver 130, an LCD panel 140, and a backlight unit 150. The LCD apparatus 100 displays a color image by dividing the frame into a plurality of periods in which different colors are displayed.

The timing controller 110 receives a timing control signal 110*a* and a data signal 110*b* from an external device such as a graphic controller, etc. The timing controller 110 generates and outputs a control signal for driving the LCD apparatus 100 in response to the timing control signal 110*a*. For example, the timing controller 110 outputs a data control signal 120*a* controlling the data driver 120, a gate control signal 130*a* controlling the gate driver 130 and a backlight control signal 150*a* controlling the backlight unit 150.

In response to the data control signal 120*a* provided from the timing controller, the data driver 120 changes the data signal 110*a* into an analog data-voltage and outputs the analog data-voltage to the LCD panel 140.

In response to the gate control signal 130*a* provided from the timing controller, the gate driver 130 generates a gate signal and outputs the gate signal to the LCD panel 140.

The LCD panel 140 includes a first substrate (not shown) and a second substrate (not shown). The second substrate is combined with the first substrate to receive a liquid crystal (not shown) in a space defined between the first and second substrates. The first substrate includes a plurality of gate lines GL and a plurality of data lines DL crossing the gate lines GL. The gate lines GL and the data lines DL defines a plurality of pixel parts P.

Each pixel part P includes a switching element TFT electrically connected to the gate lines GL and the data lines DL, a liquid crystal capacitor Clc electrically connected to the switching element TFT and a storage capacitor Cst.

In the present invention, the second substrate corresponds to a color filter-less substrate having no color filters formed thereon.

The backlight unit 150 includes light-emitting units 152 generating light and a light-emitting controller 154 controlling the light-emitting units 152.

The light-emitting units 152 are located under the LCD panel 140 and provide light to the LCD panel 140. The light-emitting units 152 are located along the gate lines GL of the LCD panel 140, for example, eight light-emitting units 152 may be so located. Alternatively, the number of the light-emitting units 152 may be variously changed according to a size of the LCD panel 140 and the desired luminance.

Under control of the light-emitting controller 154, the light-emitting units 152 generate light having a different color corresponding to each period. For example, the light-emitting units 152 sequentially generate red light, green light and blue light corresponding to each period during one frame.

The light-emitting units 152 located along a first gate line and a last gate line, which are located at an edge portion of the backlight unit 150, have a longer driving time than that of the light-emitting units 152 located closer to the center portion of the backlight unit 150. When the light-emitting units 152 located at an edge portion of the backlight unit 150, have a longer driving time than that of the light-emitting units 152 located closer to a center portion of the backlight unit 150, the luminance difference between the edge and center portions of the backlight unit 150 is corrected.

Figure 2:
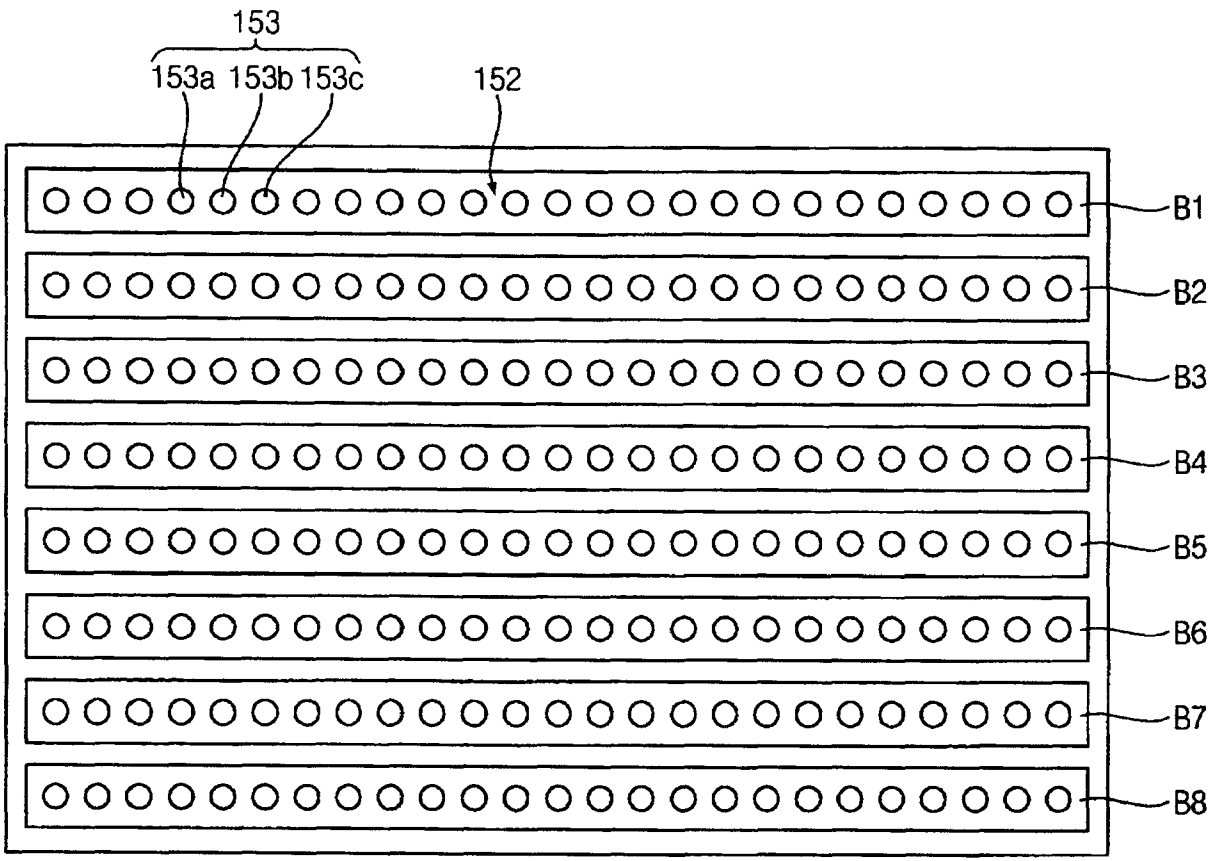
FIG. 2 is a plan view illustrating an arrangement of light-emitting units when the number of the light-emitting units is eight.

FIG. 2 is a plan view illustrating an arrangement of light-emitting units when the number of the light-emitting units is eight.

Referring to FIGS. 1 and 2, the eight light-emitting units 152 are located along the gate lines GL such that the light-emitting units 152 are spaced apart from each other by a uniform interval.

Each light-emitting unit 152 generates the light having different colors respectively in each period during one frame. Each light-emitting unit 152 includes a plurality of light-emitting elements 153. For example, the light-emitting elements 153 include a red light-emitting diode 153*a*, a green light-emitting diode 153*b* and a blue light-emitting diode 153*c*. The red light-emitting diode 153*a* generates red light, the green light-emitting diode 153*b* generates green light, and the blue light-emitting diode 153*c* generates blue light. Under the control of the light-emitting controller 154, the red light-emitting diode 153*a*, the green light-emitting diode 153*b* and the blue light-emitting diode 153*c* sequentially generate red light, green light and blue light during each period of one frame. The red light-emitting diode 153*a*, the green light-emitting diode 153*b* and the blue light-emitting diode 153*c* may be arranged in various shapes.

When the eight light-emitting units 152 are spaced apart at a uniform interval and have the same-number of the light-emitting elements 153, the amount of light arriving at the edge portion of the LCD panel 140 is less than the amount of light arriving at the center portion of the LCD panel 140 thereby causing a luminance difference between the edge and more central portions of the LCD panel 140. The edge portion corresponds to the first and eighth light-emitting units B1 and B8, and the more central portion corresponds to the second to seventh light-emitting units B2 to B7.

Therefore, when the light-emitting units 152 located at the edge portion, or the first light-emitting unit B1 and the eighth light-emitting unit B8 are operated longer than the light-emitting units 152 located at the more central portion or the second to seventh light-emitting units B2 to B7, the shortage of light arriving at the edge portion is compensated, so that luminance uniformity is improved.

Figure 3:
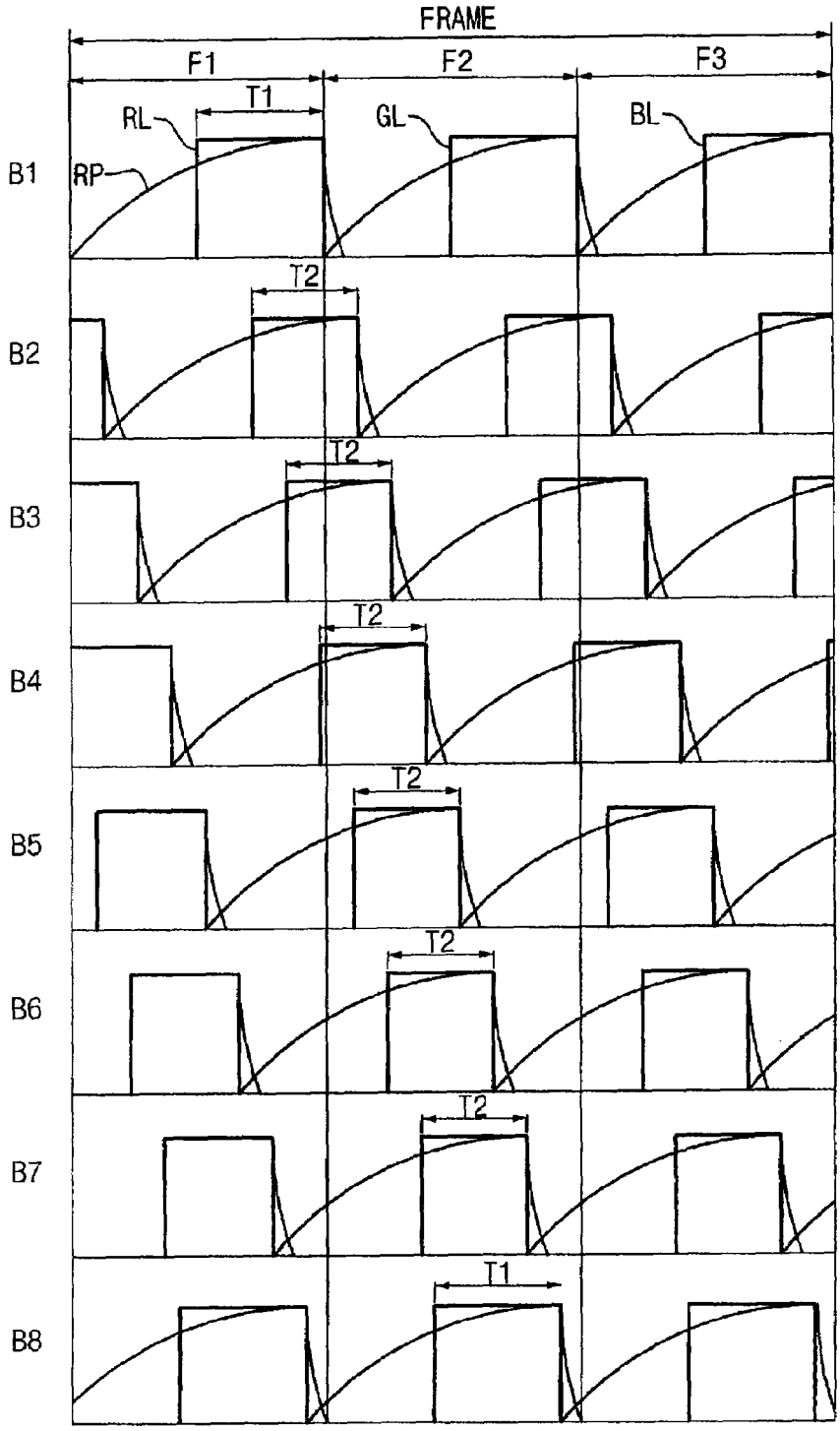
FIG. 3 is a timing chart showing a method of driving the light-emitting unit in FIG. 2.
Figure 4:
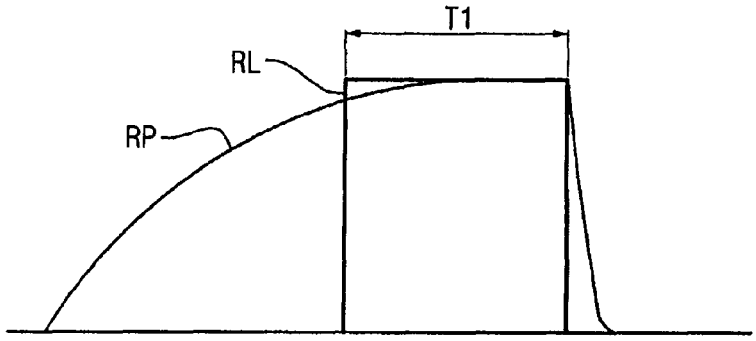
FIG. 4 is a timing chart showing a driving time of the first light-emitting unit in FIG. 3.
Figure 5:
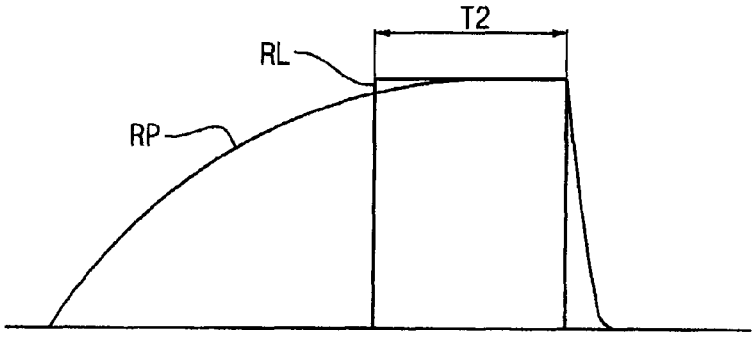
FIG. 5 is a timing chart showing a driving time of the second light-emitting unit in FIG. 3.

FIG. 3 is a timing chart showing a method of driving the light-emitting unit in FIG. 2, FIG. 4 is a timing chart showing a driving time of the first light-emitting unit in FIG. 3, and FIG. 5 is a timing chart showing a driving time of the second light-emitting unit in FIG. 3.

Referring to FIGS. 1 to 3, one frame FRAME of the LCD apparatus 100 is divided into three periods F1, F2 and F3.

Generally, the liquid crystal layer of the LCD panel 140 controls the transmittance of the light in response to the data voltage provided to the data lines DL. As shown in FIG. 4, the voltage-transmittance response waveform RP of the liquid crystal layer gradually increases from an initial time to an ending time during which the liquid crystal layer is driven. Then, an overlapping region of the response waveform RP and the light-emitting time T1 of the light-emitting unit 152 corresponds to luminance of the light transmitted through the LCD panel 140.

Also, according as the first gate line to the last gate line of the LCD panel 140 are sequentially driven, the response waveforms RP of the liquid crystal layer corresponding to the first to eighth light-emitting units B1 to B8 are sequentially delayed by a predetermined time.

In order to improve the transmittance, the light-emitting units 152 are driven to be synchronized with the response waveform RP. In other words, the light-emitting units 152 are driven such that a turn-on time of the light emitting units 152 are subsequently delayed as much as the response waveform RP of the liquid crystal layer is delayed from the first light-emitting unit B1 to the eighth light-emitting unit B8.

Referring to FIGS. 3 and 4, the first light-emitting unit B1 generates light having different colors respectively during a first time T1 in each period F1, F2 and F3. In detail, the first light-emitting unit B1 generates red light RL during the first time T1 in the first period F1, generates a green light GL during the first time T1 in the second period F2 and generates a blue light BL during the first time T1 in the third period F3. Alternatively, the light-emitting order of the red light RL, the green light GL and the blue light BL may be variously changed.

Referring to FIGS. 3 and 5, the second to seventh light-emitting units B2 to B7 start to emit the light such that a turn-on time of the second to seventh light-emitting units B2 to B7 are sequentially delayed by a predetermined time in comparison with a light-emitting starting time of the first light-emitting unit B1. Also, the second to seventh light-emitting units B2 to B7 generate the light during a second time T2 that is shorter than the first time T1 of the first light-emitting unit B1.

The eighth light-emitting unit B8 generates the light during the first time T1 that is much the same as that of the first light-emitting unit B1.

For example, when the LCD apparatus 100 is driven at 60 Hertz, one frame FRAME is about 16.7 ms and the first to third periods F1, F2 and F3 are about 5.6 ms, which is one third of one frame. Then, the second time T2 is in a range of about 2.1 ms to 2.3 ms, and the first time T1 is in a range of about 2.4 ms to 2.6 ms. In other words, the second to seventh light-emitting units B2 to B7 generate light during about 2.1 ms to 2.3 ms and the first and eighth light-emitting units B1 and B8 generate light during about 2.4 ms to 2.6 ms.

In the present invention, the light-emitting time of the first and eighth light-emitting units B1 and B8 located at the outermost edge portion is increased in comparison with the light-emitting time of the second to seventh light-emitting units B2 to B7 located between the first and eighth light-emitting units B1 and B8 to enhance luminous uniformity.

Alternatively, when the distance between a center portion of the backlight unit and a light-emitting unit increases, the light-emitting unit may be driven such that the light-emitting time is gradually increased. For example, the fourth light-emitting unit B4 and the fifth light-emitting unit B5 generate light during the shortest time. Then, the driving time of the third light-emitting unit B3 to the first light-emitting unit B1 may be gradually increased. Also, the driving time of the sixth light-emitting unit B6 to the eighth light-emitting unit B8 may be gradually increased.

Alternatively, the third to sixth light-emitting units B3 to B6 generate light during the shortest time. Then, the driving time of the third light-emitting unit B2 to the first light-emitting unit B1 may be gradually increased. Also, the driving time of the seventh light-emitting unit B7 to the eighth light-emitting unit B8 may be gradually increased.

Figure 6:
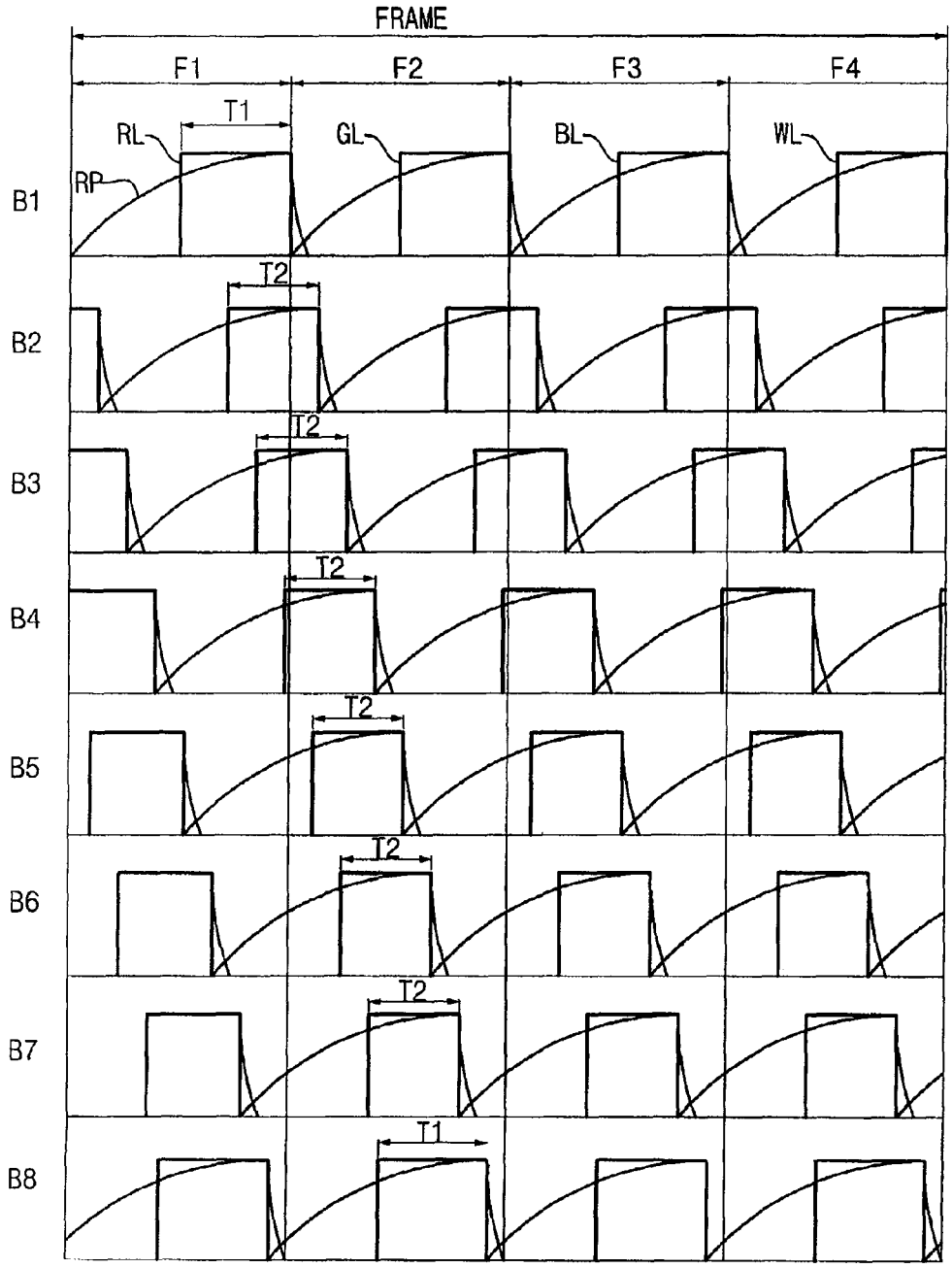
FIG. 6 is a timing chart showing a method of driving a light-emitting unit in accordance with another example embodiment of the present invention.

FIG. 6 is a timing chart showing a method of driving a light-emitting unit in accordance with another example embodiment of the present invention.

Referring to FIGS. 1, 2 and 6, one frame FRAME of the LCD apparatus 100 displays a color image of a frame by dividing the frame into four periods F1, F2, F3 and F4, in which different colors are displayed.

The light-emitting units 152 generate light having different colors in each period F1, F2, F3 and F4. For example, the light-emitting units 152 generate a red light RL in the first period F1, a green light GL in the second period F2, a blue light BL in the third period F3 and a white light WL in the fourth period F4. Alternatively, a light-emitting order of the red light RL, the green light GL, the blue light BL and the white light WL may be variously changed.

For the light-emitting of the red light RL, the green light GL and the blue light BL, the light-emitting units 152 include a red light-emitting diode 153*a*, a green light-emitting diode 153*b* and a blue light-emitting diode 153*c*. In order to generate white light WL, the red light-emitting diode 153*a*, the green light-emitting diode 153*b* and the blue light-emitting diode 153*c* may be simultaneously operated. Alternatively, the light-emitting units 152 may further include the white light-emitting diode generating the white light WL.

The method of driving the light-emitting units 152 is substantially same as the method of driving the light-emitting units 152 in FIG. 3 except that the light-emitting units 152 is driven by dividing one frame into four periods. Namely, the light-emitting time of the first light-emitting unit B1 and the eighth light-emitting unit B8 located at the edge portion is longer than the light-emitting time of the second to seventh light-emitting units B2 to B7 located at the center portion. Therefore, a detailed explanation of the driving method will be omitted.

Figure 7:
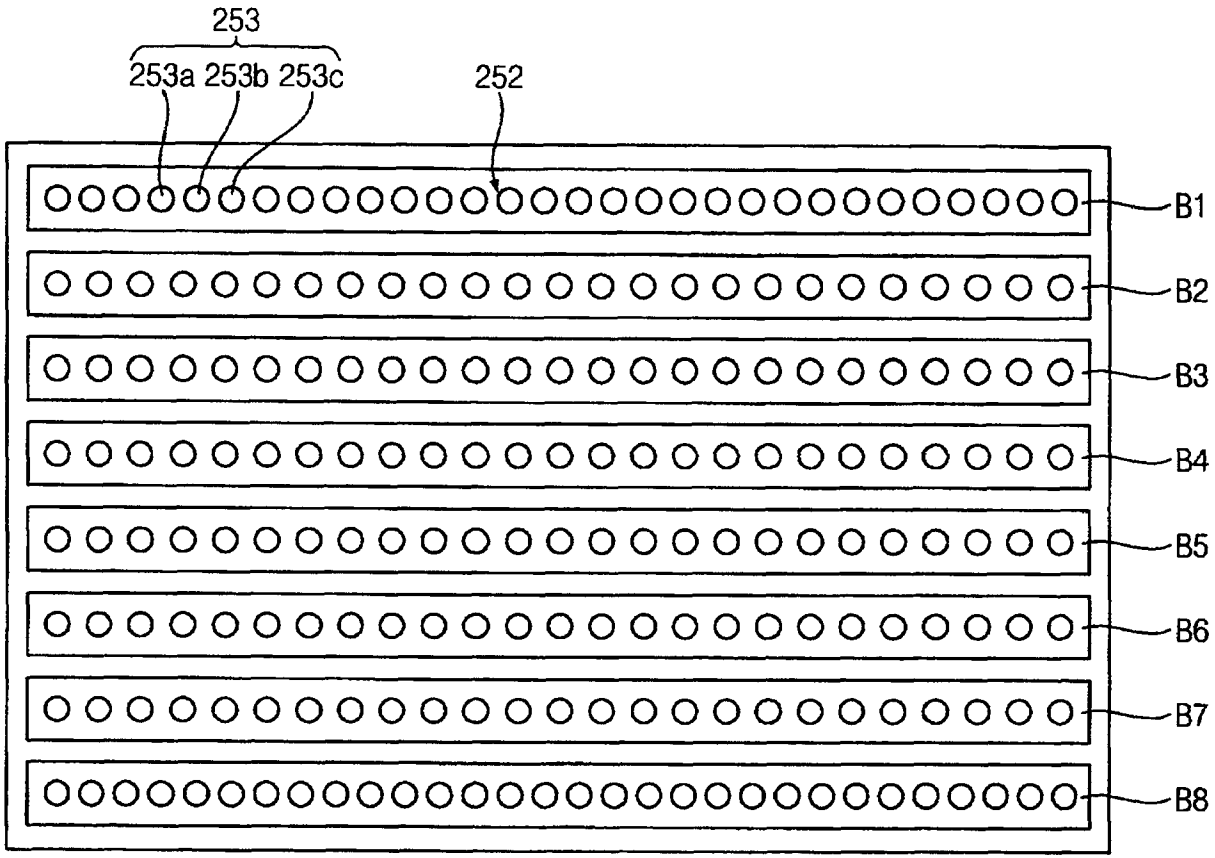
FIG. 7 is a plan view showing a light-emitting unit in accordance with another example embodiment of the present invention.

FIG. 7 is a plan view showing a light-emitting unit in accordance with another example embodiment of the present invention.

Referring to FIG. 7, a plurality of light-emitting units 252 are located at a predetermined interval along gate lines GL, for example, eight light-emitting units 152 may be so located.

Each light-emitting unit 252 generates light having different colors during a same time by a predetermined time interval in one frame. For example, the light-emitting units 252 sequentially generate red light, green light and blue light by the predetermined time-interval during one frame. Alternatively, the light-emitting units 252 sequentially generate red light, green light, blue light and white light by the predetermined time-interval during one frame.

In order to generate light, the light-emitting units 252 include a plurality of light-emitting elements 253. For example, the light-emitting elements 253 include a red light-emitting diode 253*a* generating red light, a green light-emitting diode 253*b* generating green light and a blue light-emitting diode 253*c* generating blue light.

All light-emitting units 252 generate light during the same time. However, one of the light-emitting units 252 may have more light-emitting elements 253 than the other of the light-emitting units 252 to enhance the luminance uniformity. In detail, the light-emitting units 252 located at the edge portion of the backlight unit may include more light-emitting elements 253 than the light-emitting units 252 located at the more central portion of the backlight unit.

In detail, the first light-emitting unit B1 and the eighth light-emitting unit B8 located at the outermost edge portion include more light-emitting elements than the second to seventh light-emitting units B2 to B7. Thus, the amount of the light generated from the first and eighth light-emitting units B1 and B8 is increased in comparison with the second to seventh light-emitting units B2 to B7. Substantially, the amount of light arrived at the LCD panel 140 may become uniform and thereby the luminance uniformity is improved.

Alternatively, when the distance between the center portion of a backlight unit and light-emitting units 252 is increased, the number of the light-emitting elements 253 of the light-emitting units may be gradually increased. For example, the fourth and fifth light-emitting units B4 and B5 include the least number of light-emitting elements 253. The number of the light-emitting elements of the third light-emitting unit B3 to the first light-emitting units B1 may gradually increase. The number of the light-emitting elements of the sixth light-emitting unit B6 to the eighth light-emitting unit B8 may also gradually increase. Alternatively, the third to sixth light-emitting units B3 to B6 include the least amount of light-emitting elements 253. The second light-emitting unit B2 to the first light-emitting unit B1 may have a gradually increasing number of the light-emitting elements. The number of the light-emitting elements of the seventh light-emitting unit B7 to the eighth light-emitting units B8 may also gradually increase.

As shown in the figures of the drawing, by adjusting the interval between light-emitting units, luminance may be made more uniform.

In detail, the light-emitting units located at the center portion of the backlight unit are spaced apart from each other by a first interval, and the light-emitting units located at an outermost portion of the backlight unit are spaced apart from a second outermost light-emitting unit. Alternatively, the interval between the light-emitting units may gradually decrease along a direction from the center portion of the backlight unit to the edge portion of the backlight unit.

According to one aspect of the present invention, the light-emitting time of the light-emitting units located at the edge portion is longer than the light-emitting units located at the center portion to enhance luminance uniformity.

Also, the light-emitting units located at the edge portion include more light-emitting elements than the light-emitting units located at the center portion to enhance luminance uniformity.

Furthermore, the light-emitting units may be located such that an interval between the light-emitting units may gradually decrease along a direction from the center portion of the backlight unit to the edge portion of the backlight unit to enhance luminance uniformity.

This invention has been described with reference to the example embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A liquid crystal display (LCD) apparatus displaying a color image of a frame by dividing the frame into a plurality of periods in which different colors are displayed, the LCD apparatus comprising:

an LCD panel including a plurality of gate lines and a plurality of data lines crossing the plurality of gate lines; and a plurality of light-emitting units each of which include a plurality of light-emitting elements generating different colors in each of the periods, wherein the number of light-emitting elements increases with distance from the center portion of the LCD panel to the edge portion thereof, wherein the light-emitting units face a rear surface of the LCD panel so that the light emitting units overlaps the LCD panel in a plan view.

2. The LCD apparatus of claim 1, wherein a first light-emitting unit and an n-th light-emitting unit include more light-emitting elements than second to (n−1)-th light-emitting units.

3. The LCD apparatus of claim 2, wherein each of the light-emitting elements include a red light-emitting diode generating red light, a green light-emitting diode generating green light and a blue light-emitting diode generating blue light.

4. The LCD apparatus of claim 3, wherein the frame is divided into three periods and the light-emitting unit sequentially generates the red light in a first period, the green light in a second period and the blue light in a third period.

5. The LCD apparatus of claim 3, wherein one frame is divided into four periods and the light-emitting unit sequentially generates the red light in a first period, the green light in a second period, the blue light in a third period and the white light in a fourth period.

6. The LCD apparatus of claim 1, wherein there are eight light-emitting units.

7. A liquid crystal display (LCD) apparatus displaying a color image of a frame by dividing the frame into a plurality of periods in which different colors are displayed, the LCD apparatus comprising:

an LCD panel including a plurality of gate lines and a plurality of data lines crossing a plurality of the gate lines; and a number of light-emitting units generating different colors in each of the periods, wherein the distance between the light-emitting units decrease along a direction from the center portion of the LCD panel to the edge portion thereof, wherein the light-emitting units face a rear surface of the LCD panel so that the light emitting units overlaps the LCD panel in a plan view.

8. The LCD apparatus of claim 7, wherein the distance between the light-emitting units is gradually increased closer to the center portion of the LCD panel.

* * * * *